US005896899A

United States Patent [19]

Schmitz

[11] Patent Number: 5,896,899

[45] Date of Patent: Apr. 27, 1999

[54] METHOD AND AN APPARATUS FOR STERILE BOTTLING OF BEVERAGES

[75] Inventor: Gert Anton Schmitz, Aitherhofen, Germany

[73] Assignee: Krones AG Hermann Kronseder Maschinenfabrik, Neutraubling, Germany

[21] Appl. No.: 08/592,365

[22] PCT Filed: Jul. 29, 1994

[86] PCT No.: PCT/EP94/02522

§ 371 Date: Apr. 15, 1996

§ 102(e) Date: Apr. 15, 1996

[87] PCT Pub. No.: WO95/04699

PCT Pub. Date: Feb. 16, 1995

[30] Foreign Application Priority Data

Aug. 7, 1993 [DE] Germany ..... 43 26 601

[51] Int. Cl.[6] ..... B65B 1/04

[52] U.S. Cl. ..... 141/92; 141/11; 141/85; 141/89; 141/91; 141/94; 141/168; 141/171; 134/72; 134/73

[58] Field of Search ..... 141/11, 85, 89, 141/91, 92, 94, 165, 168, 171, 172; 134/68, 72–74; 53/426, 431

[56] References Cited

U.S. PATENT DOCUMENTS

| | | | |
|---|---|---|---|
| 2,029,303 | 2/1936 | Ball . | |
| 3,143,120 | 8/1964 | Unthank | 134/73 |
| 3,839,843 | 10/1974 | Stewart, Jr. | 53/426 |
| 4,154,624 | 5/1979 | Wahl et al. | 134/10 |
| 4,409,775 | 10/1983 | Brody et al. | 53/426 |
| 4,635,662 | 1/1987 | Totten | 134/68 |
| 4,643,330 | 2/1987 | Kennedy | 220/288 |
| 4,917,267 | 4/1990 | Laverdure | 222/107 |
| 5,251,424 | 10/1993 | Zener et al. | 53/431 |
| 5,285,801 | 2/1994 | Klenk | 134/73 |
| 5,558,135 | 9/1996 | Kronseder et al. | 141/92 |

FOREIGN PATENT DOCUMENTS

| | | |
|---|---|---|
| 381841 | 8/1990 | European Pat. Off. . |
| 0 447 759 A1 | 9/1991 | European Pat. Off. . |
| 748104 | 6/1933 | France . |
| 1405493 | 5/1965 | France . |
| 733623 | 3/1943 | Germany . |

*Primary Examiner*—David J. Walczak
*Assistant Examiner*—Timothy L. Maust
*Attorney, Agent, or Firm*—Tilton, Fallon, Lungmus & Chestnut

[57] ABSTRACT

When carrying out a method for sterile bottling of beverages, which comprises the steps of cleaning the bottles first in a cleaning station by means of lye, transporting them then to a separate filling station, filling them in said filling station with the previously sterilized beverage, and closing them finally in a closing station, the sterilization of the interior of the bottles by introducing steam and/or hot water is carried out several times successively in spatially separated stations. This fractional sterilization of the bottles achieves a very high germ destruction rate, the amount of energy consumed being low and the bottles being treated carefully. In addition, measures against a reinfection of the bottles in the area of transport between the stations can be dispensed with so that a good accessibility of the transport area is guaranteed.

15 Claims, 3 Drawing Sheets

METHOD AND AN APPARATUS FOR STERILE BOTTLING OF BEVERAGES

Figure 1:
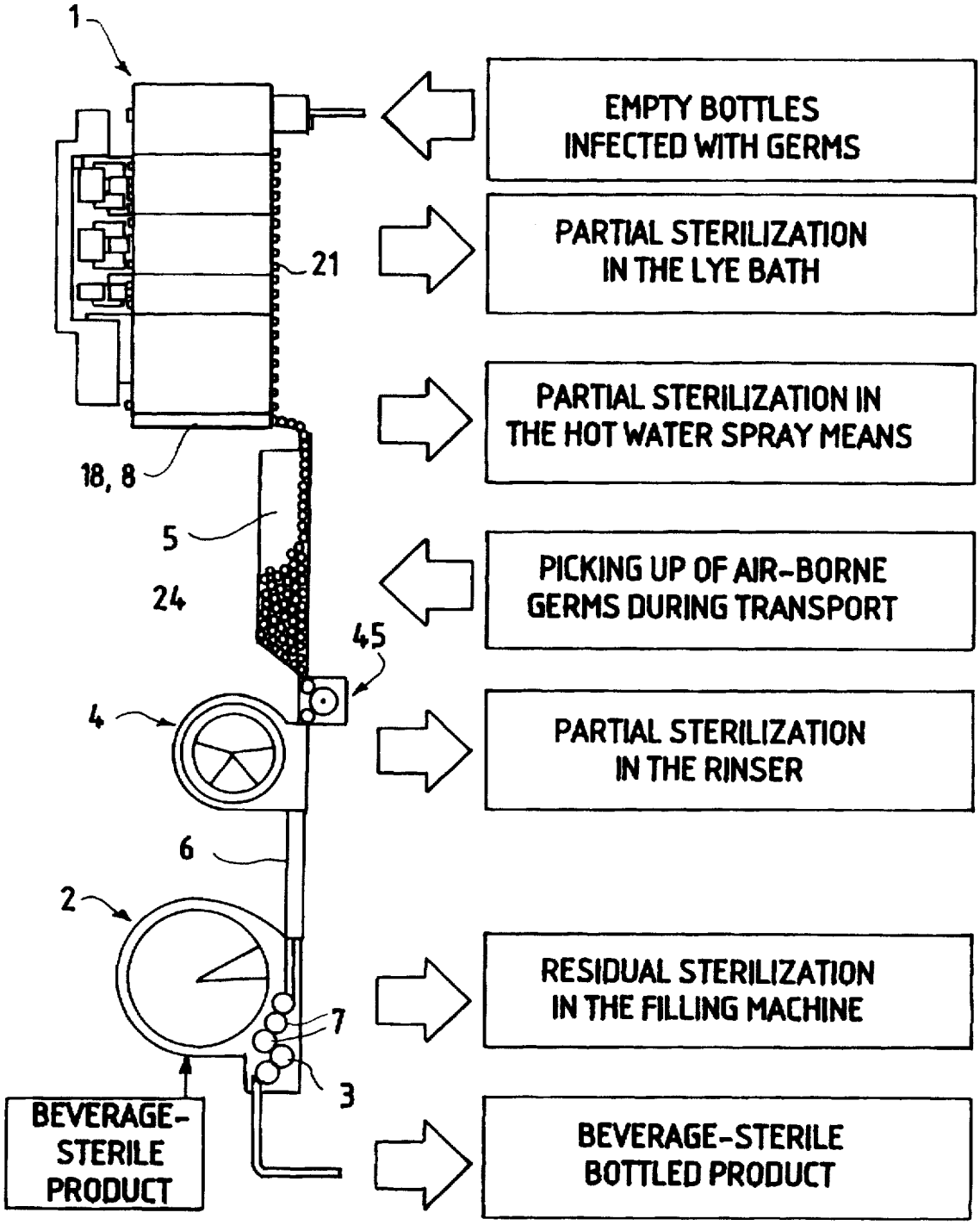

The present invention relates to a method for sterile bottling of beverages according to the generic clause of claim 1 as well as to an apparatus for carrying out said method according to the generic clause of claim 13.

DE-pat. 733 623 already discloses the measure of sterilizing, subsequent to the treatment with warm lye/liquor, the bottles within the washing machine by spraying into said bottles a liquid having a temperature of from 85° to more than 100° Celsius or steam by means of several spray nozzles, which are arranged one behind the other and which are located outside of the bottle orifice. Subsequently, the bottles are cooled down in several steps by sterilized water or sterilized air and, finally, they are discharged onto a conveyor belt. By means of this conveyor belt, the bottles are transported to a filling machine and then to a closing machine, tunnel like covers being used for the purpose of keeping the bottles sterile. However, it turned out that a completely sterile transport cannot be achieved so that it will happen again and again that bottles with germs originating from the ambient air are introduced in the filling machine. In addition, the covers prevent rapid access in the case of disturbances on the conveyor belt, and, consequently, they cannot be accepted in modern high-efficiency bottling plants including between the separate machines the conventional multi-path transport means, bottle uniting means and bottle distributing means.

A similar situation exists in the case of the method according to DE-pat. 24 37 588, where the sterilization in the washing machine is effected by spraying hot water having a temperature of from 85 to 95° Celsius onto the inner and outer sides of the bottles. Following this, the bottles are discharged from the washing machine immediately and, maintaining a temperature of from 65 to 70° Celsius, they are transported to the filling machine; in the course of this transport a laminar aeration system is supposed to provide a sterile shield against the surroundings. In spite of these complicated measures taken in the area of bottle transport and in spite of the additional heating, a formation of germs in the cleaned bottles cannot be prevented completely in this case either, and access to the conveyor system is barred to a large extent. Hence, this kind of sterile bottling of beverages could not gain acceptance in practice; it is not suitable for use in a modern high-efficiency plant.

Furthermore, German-Offenlegungsschrift 40 36 290 discloses that the bottles, which have been cleaned in the washing machine by means of lye and transported—without being shielded—to the filling machine, are sterilized, directly before the beverage flows in, by introducing steam via the reflux gas tubes of the filling members projecting into the bottles. The germs, which penetrated into the bottles already in the washing machine due to fresh-water spraying as well as in the unprotected and, consequently, easily accessible transport area and which are detrimental to the beverage, can be destroyed in this way to a large extent. The amount of energy consumed in the steam treatment period of approx. 2 seconds, which is normally used in practice, is comparatively small and, simultaneously, also the filling member is re-sterilized prior to each bottling operation. However, this course of action does not always suffice to destroy specific beverage pests, in particular the spores of moulds, with the desired high destruction rate. Although this could be remedied by an extension of the steam treatment period, such an extension of time would result in an expensive increase in the size of the filling machine as well as in intense heating of the filling members and of the glass bottles, and this may impair the taste of the beverage and increase the bottle fracture rate. In all other respects, this method is well suited for modern high-efficiency plants.

Finally, it has also been suggested that, as an alternative to the above-described sterilization within the filling machine, the sterilization should be carried out in a rinser which is interconnected with the filling machine in the case of beverages which are particularly sensitive to heat, and that the bottles should be protected by a steam passage against reinfection on their short path between the rinser and the filling machine ("KRONES Magazin" May 1992 and October 1992). Also this method is well suited for modern high-efficiency plants, but, in view of the limited period of treatment in the rinser in which the bottles are transported in a single row and at a high speed, it cannot destroy extremely resistant germs with the desired destruction rate of e.g. nine powers of ten.

It is the object of the present invention to permit, in the case of a method of the type mentioned at the beginning, a sufficiently high destruction rate of beverage pests with the aid of simple means, even if said beverage pests are extremely resitant to heat, as well as a trouble-free operation with high efficiency. In addition, an apparatus for carrying out this method is to be provided.

As far as the method is concerned, this object is achieved by the features disclosed in the characterizing clause of claim 1.

It follows that, when the method according to the present invention is used, the sterilization of the bottle interior does not take place in one station in a concentrated manner, but, contrary to the hitherto prevailing trend, it takes place in several phases and stations, respectively, which are displaced in space and shifted in time. Due to the increase in temperature in the subsequent phase, which is based on the heating effected in the preceding phase, a synergistic effect is obtained by means of which the destruction effect is increased enormously. Hence, even the particularly heat-resistant spores of the dreaded moulds Byssochlamys fulva, Byssochlamys nivea and Neosartorya fischeri can be destroyed with very high destruction rates using an economical amount of energy. In addition, it is not necessary to take any measures against reinfection between the individual phases and stations of the sterilization of the interior of the bottles, since the small number of germs picked up during transport will be destroyed in the subsequent sterilization phase. It follows that the method according to the present invention is ideally suited to sterile bottling of beverages in modern high-efficiency plants comprising several separate machines and intermediate transport means.

Advantageous further developments of the method according to the present invention are disclosed in claims 2 to 12. A further development which is specially emphasized is the sterilization of the interior of the bottles by means of superheated water according to claim 5 in a room under a pressure above atmospheric pressure according to claim 10. This method permits a purposeful high supply of heat down to the base of the bottle within a short period of treatment even by means of nozzles located outside of the bottles and, consequently, it is particularly suitable for use in the cleaning station and adapted to be carried out by normal spray nozzles. In addition, it is definitely not necessary to heat the whole bottle wall during each sterilization of the bottle interior. On the contrary, it will suffice to carry out, according to claim 6, a socalled skin sterilization in the interior. This will keep the energy consumption low and, in cases in which glass bottles are treated, the bottle fracture rate surprisingly low without any deterioration of the destruction effect.

As far as the apparatus is concerned, the task underlying the present invention is solved by the features of claim 13.

An apparatus according to the present invention has a similarly simple and clear structural design as an apparatus without sterilization. It is easily accessible, especially in the area of the bottle conveyors, so that malfunctions can be eliminated at any time, whereby a high efficiency can be maintained. In spite of these features, a very high destruction rate is obtained by the repeated sterilizations of the interior of the bottles.

Advantageous further developments of the apparatus according to the present invention are disclosed in claims 14 to 29. As can be seen from claims 26 and 27, a conventional electronic empty-bottle inspection machine can easily be integrated in the apparatus, if the bottles in question are returnable bottles wich are to be examined so as to find out whether they are clean and whether any damage has been caused to them. It will only be necessary to take care that excessive reinfection is avoided by keeping the centering bells, which are applied to the bottle orifices, sterile. By means of the lubrication of the conveyor belts with a heated lubricant, which is disclosed in claim 29, the particularly endangered base of the bottle can be heated.

Figure 2:
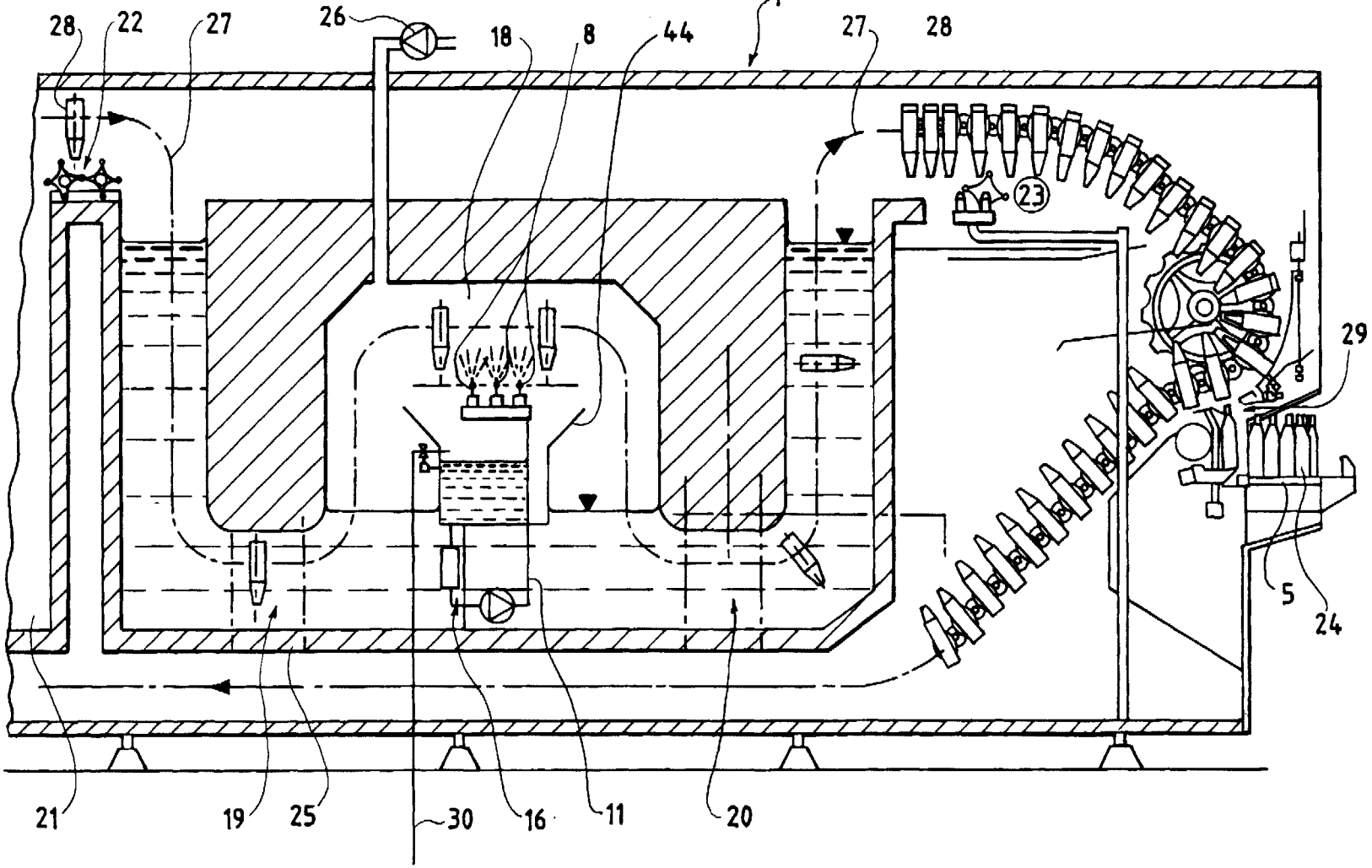
Figure 3A:
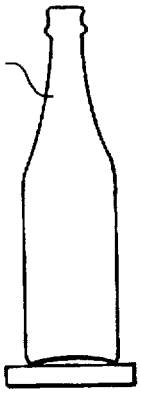
Figure 3B:
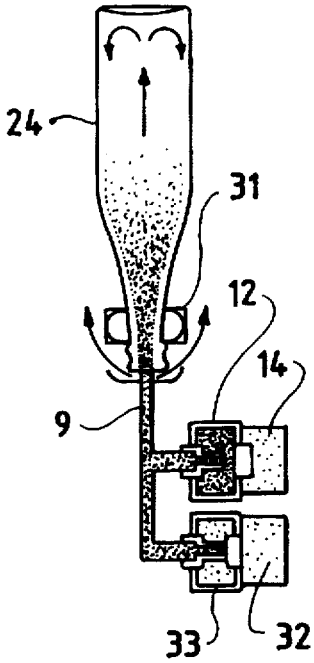
Figure 3C:
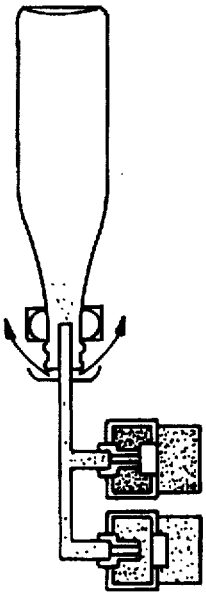
Figure 3D:
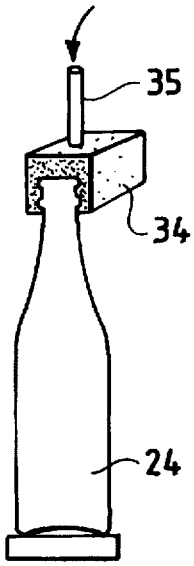
Figure 4:
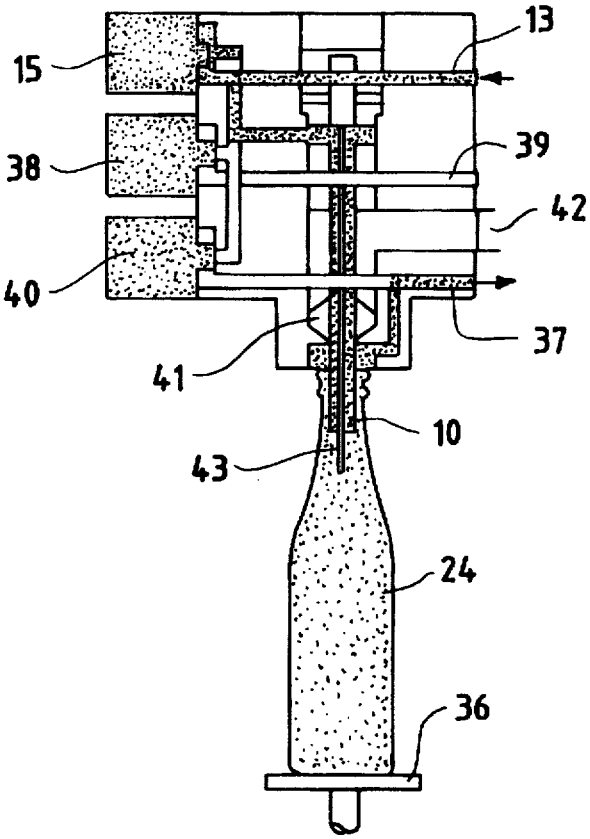

In the following, an embodiment of the present invention will be described on the basis of the drawings, in which FIG. 1 shows a schematic top view of a plant for sterile bottling of fruit juice in returnable glass bottles with a short description of the sequence of method steps, FIG. 2 shows the vertical partial section through the cleaning machine of the plant according to FIG. 1 in the area of the means for sterilizing the bottle interior, FIG. 3 shows a schematic representation of the four treatment phases in the rinser of the plant according to FIG. 1, FIG. 4 shows the vertical section through a filling member of the filling machine of the plant according to FIG. 1 during sterilization of the interior.

The plant according to FIGS. 1 to 4 is designed for sterile bottling of fruit juice in returnable bottles 24 made of glass. It comprises a cleaning machine 1, a rinser 4, a filling machine 2 and a closing machine 3.

As can be seen from FIG. 2, the cleaning machine 1 is a double-end type cleaning machine including, subsequent to the last lye/liquor bath 21 and a hot water spray means 22, a pressure chamber 18 in the form of a box which is open at the bottom. The pressure chamber 18 is immersed into a tank 25 filled with hot water and the interior of said pressure chamber 18 has applied thereto an overpressure of 0.1 bar, e.g. by means of a compressor 26, which, controlled by a control means which is not shown, presses sterile air into said pressure chamber 18. This has the effect that, in the interior of the pressure chamber 18, a water level is obtained which is one metre lower than the water level in the tank 25. The two lateral walls of the pressure chamber 18, which extend in the direction of movement, define together with the tank 25 a siphon-type inlet gate 19 and a siphontype outlet gate 20. After having passed the hot water spray means 22, the bottles 24 are transported, by means of the bottle cells 28 suspended from endless, continuously driven chains 27, downwards into the tank 25, horizontally through the inlet gate 19, upwards into the interior of the pressure chamber 18 beyond the water level, a short distance horizontally, then again downwards into the water bath, in the horizontal direction through the outlet gate 20, and finally upwards out of the tank 25 and to a final hot water spray means 23. Subsequently, the bottles 24 travel to the discharge means 29 where they are guided out of the bottle cells 28 and put down on a bottle conveyor 5.

Three parallel spray tubes 8, which are provided with a number of nozzle openings corresponding to the number of bottles 24 per bottle cell 28, are provided in the interior of the pressure chamber 18 below the horizontal path of movement of the bottles 24 and above the water level and are oriented transversely to the direction of circulation. The spray tubes 8 are rotatably supported and are rotated by means, which are not shown, synchronously with the movement of the bottles 24 so that the water jets ejected from the nozzles first enter the bottle at an oblique angle, whereupon they are directed perpendicularly upwards and hit the bottom, and, finally, they are directed at an oblique angle downwards acting on the bottle along the bottle wall. The three spray tubes 8 are connected via a line 11 to a generator 16 for superheated water of 105° Celsius including a high-pressure pump. In view of the overpressure prevailing in the pressure chamber 18, the superheated water is sprayed by the spray tubes 8 into the bottles 24 without excessive steam formation, and there it hits mainly the bottom of said bottles 24. This has effect that a high amount of heat is introduced in the bottle over a short path and within an extremely short period of time so that a temperature which is much higher than 100° Celsius will be obtained in the whole interior of the bottles 24. The water running out of the bottles 24 is collected in a basin 44 and returned to the generator 16 for superheated water. Part of the superheated water is converted into steam during the spraying process and condenses within the pressure chamber 18, whereby the amount of water in the tank 25 will be increased. This increase is compensated for by an overflow means, which is not shown. Accordingly, the basin 44 is also additionally connected to a fresh water supply line 30 through which the condensed water is automatically replaced.

In the pressure chamber 18 of the cleaning machine 1, the bottles 24 are, consequently, subjected to a first sterilization of the bottle interior by spraying in superheated water, and, together with the preceding cleaning by means of hot lye, this sterilization will achieve a virtually complete destruction of all germs in the interior of the bottles 24. In the area of the outlet gate 20 and, if provided, in the area of the subsequent hot water spray means 23, the bottles 24 are then slightly cooled down so that they will leave the cleaning machine 1 at a temperature of approx. 80 to 90° Celsius. Cooling down to a lower temperature is possible as well. This can already be initiated by the water spray means 22 in front of the pressure chamber 18, since, as has already been stated, the bottle wall is heated only partly by the spray tubes 8. The outer wall can, consequently, easily have a temperature which is much lower than 100° Celsius.

The bottle conveyor 5, to which the bottles 24 are transferred from the cleaning machine 1, is defined, as is normally the case, by a plurality of motor-driven hinge band chains transporting the bottles 24 in several rows and at an upright position. At the end of the bottle conveyor 5, a uniting means is provided with the aid of which the bottles 24 are united so as to form a single row and simultaneously accelerated. In the whole area of the bottle conveyor 5, including its uniting means, neither any cover nor any shield is provided for the bottles 24 so that, in the case of malfunction caused by bottles 24 which have fallen over or become stuck etc., the operator can intervene rapidly and unhindered. The bottles 24 on the bottle conveyor 5 cool down gradually and, during normal operation, they have a temperature of approx. 60° Celsius in the area in which they are united. By heating the normally used chain lubricant prior to spraying it onto the hinge band chains, a slightly higher temperature can be maintained in the bottom area.

The bottle conveyor 5, which, being a continuous conveyor, has also a certain buffer function, is followed by a rinser 4 of the circulation type. This rinser 4 comprises a feed worm, a feed star, a rotor provided with pivotable and controllable grippers 31 for the bottles 24, and a discharge star. The bottles 24, which are fed at an upright normal position (FIG. 3*a*), are pivoted by 180° by means of said grippers 31 so that their orifice faces dowards. At this position, nozzles, which are formed by perpendicular rinsing tubes 9 open at the top, are introduced into the necks of said bottles 24. The rinsing tubes 9 rotate together with the rotor and are connected to a ring main 13 via individually controllable control valves 14. Said ring main 12 contains saturated steam, which has a temperature of approx. 105° Celsius and which is blown into the bottle interior for a period of e.g. 6 seconds by time-controlled opening of the control valve 14 (FIG. 3*b*). The steam can escape into the open air through the annular gap between the rinsing tube 9 and the orifice of the bottle.

Each rinsing tube 9 is additionally connected via a further control valve 32 to a further ring main 33, which contains sterile air. After the steam treatment, this sterile air is blown into the interior of the bottle for a period of e.g. 3 seconds by time-controlled opening of the control valve 32 Description (FIG. 3*c*). This has the effect that the condensate produced during the steam treatment is removed by rinsing and that the interior of the bottle 24 is dried. Subsequently, the bottles 24 are pivoted back to their normal position by means of the grippers 31, and, when they occupy said normal position, they are discharged from the rinser 4 (FIG. 3*d*).

It follows that, in said rinser 4, the bottles 24 are subjected to a second sterilization of the bottle interior by blowing in saturated steam. In the course of this second sterilization, the inner wall of the bottles 24, which come in with a temperature of approx. 60° Celsius, is heated to a sterilization temperature of more than 100° Celsius in all areas. Hence, the germs, which penetrated into a bottle 24 through the open orifice thereof in the course of the transport of said bottle on the bottle conveyor 5, will be destroyed again to a very large extent.

From the rinser 4, the bottles 24 are transported by means of a short, single-path screw conveyor 6 to the filling machine 2. Instead of this screw conveyor 6, it is also possible to provide a direct interconnection by providing an arrangement in which the discharge star of the rinser 4 is in mesh with the feed star of the filling machine 2 directly or via an intermediate transfer star. In any case, malfunction need not be expected in this area in view of the forced-type transport of the bottles 24. Hence, a tunnel 34 with a steam supply line 35 can be arranged in the area of the orifices of the bottles 24, said tunnel 34 preventing an ingress of germs into the bottle openings to a very large extent (FIG. 3*d*).

The filling machine 2 provided with a feed star, a rotor and a discharge star corresponds to the filling machine according to German-Offenlegungsschrift 40 36 290 with regard to its structural design. Hence, it includes a plurality of filling members 17 of the same kind, which are arranged on the circumference of the rotor, as well as lifting members 36, which are associated with said filling members 17 and which circulate together therewith. The empty bottles 24 coming from the rinser 4 are first lifted by the lifting members 36 part of the distance towards the filling members 17. In the course of this process, a reflux gas tube 10 penetrates into the bottle neck. This reflux gas tube is connected via passages in the filling member 17 to a line 13 by time-controlled opening of a control valve 15, said line 13 containing saturated steam having a temperature of e.g. 105° Celsius. It follows that this saturated steam flows for a predetermined period of time of e.g. 2 seconds through the reflux gas tube 10, or rather through the nozzle defined by the opening of said reflux gas tube 10, centrally into the bottle 24 and down to the bottom, whereupon it escapes through the annular gap between the reflux gas tube 10 and the orifice of the bottle into a reflux gas channel 37 (FIG. 4). In the course of this process, the whole interior of the bottle 24, which, coming from the rinser 4, already has a very high temperature level, is heated to a temperature which is much higher than 100° Celsius.

It follows that, in the filling machine 2, each bottle 24 is subjected to a third and last sterilization of its interior by blowing in saturated steam. During this last sterilization also the germs and beverage pests which "survived" the first sterilization of the bottle interior in the cleaning machine 1 and the second sterilization of the bottle interior in the rinser 4 will be destroyed with a high degree of certainty. On the whole, the destruction rate which can be achieved by the "fractional sterilization" according to the present invention is much higher than that achieved on the basis of the same sterilzation time and the same amount of energy in only one station.

When the control valve 15 has been closed, the pressurizing gas valve 38 of the filling member 17 will be opened, whereupon $CO_2$ will be introduced from a channel 39 via the reflux gas tube 10 into the bottle 24. This will have the effect that most of the sterilization steam as well as most of the condensate formed are discharged into the open air. Following this, the lifting member 36 is lifted still further, whereby the bottle 24 will be pressed against the filling member 17 completely and tightly so that it will be filled with $CO_2$ until the adjusted counterpressure of e.g. 3 bar has been reached, the pressurizing gas valve 38 being still open. Instead of $CO_2$, it is, of course, also possible to use sterile air as a pessurizing gas and as a flush gas. When the pressurizing process has been finished, the pressurizing gas valve 38 will be closed and, subsequently, the reflux gas valve 40 and the liquid valve 41 will be opened simultaneously. The fruit juice to be bottled, which has previously been sterilized e.g. by sterile filtration, can now flow into the bottle 24 through the product line 42 and the discharge opening of the filling member 17. When the predetermined filling level, measured by an electric probe 43, has been reached, the liquid valve 41 will be closed, whereby the filling operation will be finished.

Following this, the lifting member 36 is lowered together with the filled bottle 24. At the discharge end of the filling machine 2, the bottles 24 are taken over by transport stars 7 on a normal transport level and transferred to the closing machine 3. An ingress of germs can again be avoided by blowing in steam by means of a tunnel according to FIG. 3*d*. In the closing machine 3, the bottles 24 are then closed by crown corks or the like, which have previously been sterilized by means of steam.

If returnable bottles are filled, a conventional electronic inspection machine 45 for empty bottles can easily be integrated in the plant according to FIG. 1 to 4, preferably between the bottle conveyor 5 and the rinser 4. In this connection, it will be advantageous to make the centering bells of the empty-bottle inspection machine sterilizable, said centering bells being applied in the area of the orifices of the bottles. Such sterilization can be effected e.g. by an integrated heating maintaining the centering bells constantly at a temperature of more than 100° Celsius. It is also possible to carry out chemical sterilization or heat sterilization by singeing or irradiation at certain intervals.

The treatment of the bottles, jars or similar vessels in the cleaning machine 1 can also be carried out by means acid instead of lye, or in addition to the lye.

I claim:

1. An apparatus for sterile bottling of beverages comprising a cleaning machine, a filling machine and a third machine operatively associated with said cleaning machine and said filling machine for performing a supplemental function on the bottle, all said machines being interconnected via bottle conveyors, wherein said cleaning machine and at least one additional said machine (1, 2) are provided with means (8, 10) for introducing steam and/or superheated water into the interior of the bottle, said means for introducing steam and/or superheated water (8, 9, 10) includes at least one nozzle connected to a steam and/or hot-water line (11, 12, 13), and wherein said nozzle (9, 10) is adapted to be inserted into said interior of said bottle.

2. An apparatus according to claim 1 wherein said nozzle (8, 9, 10) is adapted to be moved along with said bottle.

3. An apparatus according to claim 1 wherein the nozzle (10) is defined by a filling tube of a filling member (17) of said filling machine (1).

4. An apparatus to claim 1, wherein said nozzle (8) is defined by at least one spray tube of said cleaning machine (1), and said spray tube is supported in said cleaning machine (1) such that said spray tube is adapted to be rotated or to be displaced along a straight line.

5. An apparatus according to claim 1 wherein said cleaning machine (1) has formed therein a pressurized clamber (18) provided with a siphon-type inlet gate (19) and a siphon-type outlet gate (20) for said bottles, and that said means (8) for introducing steam and/or superheated water is arranged in said pressure chamber (18).

6. An apparatus according to claim 5, and wherein said cleaning machine comprises a plurality of lye baths and means (29) for discharging bottles to a bottle conveyor (5), and wherein said pressure chamber (18) is arranged between the last of said lye baths (21) and said bottle discharge means (29).

7. An apparatus according to claim 1 wherein an empty-bottle inspection machine is inserted between said cleaning machine (1) and said filling machine (2) or said third machine and wherein centering bells of said empty-bottle inspection machine, which are applied to the orifices of said bottles, are adapted to be sterilized.

8. An apparatus according to claim 7, wherein said centering bells are adapted to be heated.

9. An apparatus according to claim 1 wherein, subsequent to said cleaning machine (1), a bottle conveyor (5) is designed for multi-row transport of said bottles and is substantially freely accessible from above and/or from the side.

10. An apparatus according to claim 9 wherein said bottle conveyor is multi-path and includes hinge band chains which are lubricated with a heated lubricant.

11. A method for sterile bottling of beverages, comprising the steps of cleaning the bottles first in a cleaning station by means of lye, transporting them then to a separate filling station, filling them in said filling station with the previously sterilized beverage, and closing them finally in a closing station, the improvement comprising the additional step of sterilizing the interior of the cleaned, empty bottles by introducing steam and/or superheated water carried out several times successively in spatially separated stations, wherein one of said stations is the cleaning station, and transporting said bottles at an upright position and with open orifices between the stations where said interior of said bottles is sterilized.

12. A method according to claim 11, and, between the temporally separated sterilizations of the interior of the bottles, transporting said bottles without said bottles being covered, aerated, irradiated and without any other measures of this kind, which counteract germ formation, being taken.

13. A method according to claim 11 or 12, wherein one of said sterilizations of said interior of said bottles is carried out in said filling station.

14. A method according to claim 11 or 12 wherein at least one of said sterilizations of said interior of said bottles is carried out in a separate sterilization station arranged between said cleaning station and said filling station.

15. A method according to claim 11 or 12, wherein at least one of said sterilizations of said interior of said bottles is carried out in a room under a pressure above atmospheric pressure.

* * * * *

UNITED STATES PATENT AND TRADEMARK OFFICE

CERTIFICATE OF CORRECTION

PATENT NO. : 5,896,899

DATED : April 27, 1999

INVENTOR(S) : Gert Anton Schmitz

It is certified that error appears in the above-indentified patent and that said Letters Patent is hereby corrected as shown below:

Column 7, Claim 5, Line 29, "clamber" should be —chamber—.

Signed and Sealed this

Twenty-sixth Day of October, 1999

*Attest:*

Q. TODD DICKINSON

*Attesting Officer*

*Acting Commissioner of Patents and Trademarks*